United States Patent [19]

Marmor

[11] Patent Number: 4,802,252

[45] Date of Patent: Feb. 7, 1989

[54] BEDCLOTHING SUPPORT

[76] Inventor: Adrian Marmor, 300 Millbank Rd., Bryn Mawr, Pa. 19010

[21] Appl. No.: 43,951

[22] Filed: Apr. 29, 1987

[51] Int. Cl.[4] ..... A47C 21/02

[52] U.S. Cl. ..... 5/505; 248/166

[58] Field of Search ..... 5/505, 506, 504, 503, 5/508; 248/166, 434

[56] References Cited

U.S. PATENT DOCUMENTS

| | | | |
|---|---|---|---|
| 2,618,789 | 11/1952 | Kane | 5/505 |
| 2,642,589 | 6/1953 | Cobb | 5/505 |
| 2,676,340 | 4/1954 | Garriot et al. | 5/505 |
| 4,570,275 | 2/1986 | Merriman | 5/505 |

*Primary Examiner*—Alexander Grosz

*Attorney, Agent, or Firm*—Frederick J. Olsson

[57] ABSTRACT

Device for preventing bed clothing from exerting pressure on the feet. The device has a base portion to fit between the mattress and the box spring, a connector portion that extends vertically, and a support portion that extends horizontally over the mattress. These portions are formed from rods and pivots rotatably mounting the rods. This stucture allows the device to be folded flat for storage and to be folded to the desired shape for use on a bed.

3 Claims, 2 Drawing Sheets

BEDCLOTHING SUPPORT

This invention relates to means for preventing bed clothing from exerting pressure on the feet and particularly the toes of a person in the bed.

It is well-known that bed clothing, which is normally tucked in at the foot of the bed, can create pressure on the feet and toes. Sufficient pressure can cause toes to bind backwards or cause the feet to bend downwardly. For people who are prone on their backs either because of sleeping or medical confinement, this can result in much discomfort.

To persons who are confined to lie on their back for extended periods of time not only is there such discomfort, but in many instances pressure poses a health hazard. For example, for a person confined to a bed for a long period of time, the pressure of the bed clothing can cause sores on toes and heels and even cause foot deformation.

Moreover, in cases where the foot and particularly the toes have been injured or subject of a disease or have been badly burned or frozen, it is highly desirable that pressure and even mere contact with the bed clothes be avoided.

The idea of supporting the bed clothes at the foot end of the bed so that the same do not contact or exert pressure on the toes and feet is well-known and many devices have been proposed to remedy the situation. For example, the devices shown in the following U.S. Pat. Nos.: 831,214; 1,072,490; 2,210,255; 2,611,139; 2,618,789; 2,646,478; 2,986,747; 3,317,932; 3,803,645; 3,808,614; 3,967,334; 4,214,327; and 4,570,275.

Such currently known devices have several shortcomings, for example, some are bulky or relatively difficult to handle, or are comprised of several parts which require relatively skilled adjustment and one of the most common faults is that when not in use, the same are not flat. The non-flat condition causes problems in transportation because of the larger size container needed for shipment means that unused spaced has to be paid for. Most importantly, the non-flat condition creates storage problems.

Devices of the kind in question need to be employed in hospitals, nursing homes, and other health care facilities where space is at a premium. Thus, such devices which for storage take up needed space or need some special storage facilities are not compatible with health care facility needs.

The prime objective of the invention is to provide a device which avoids the above shortcoming and particularly a device which can be flat folded when not in use and can be quickly folded into desired shape for use on a bed.

The invention will be described below in connection with the following drawings wherein.

Figure 1:
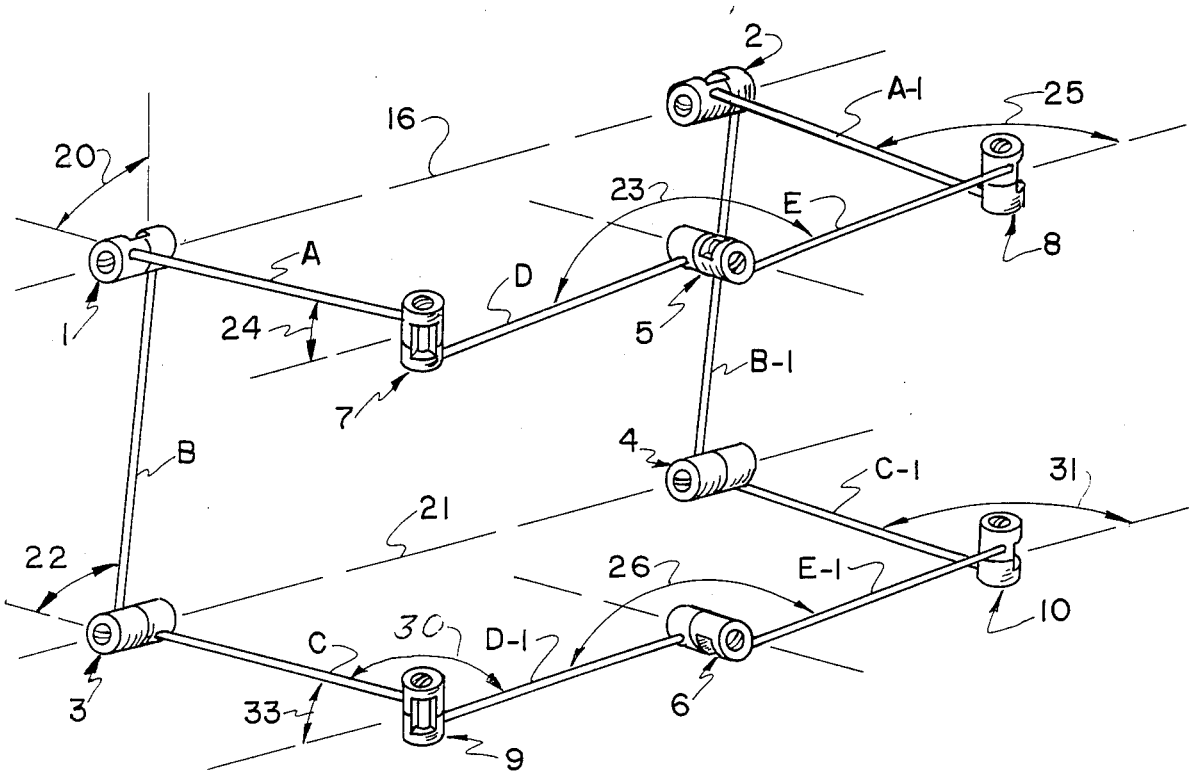
FIG. 1 is a perspective view of the device of the invention which has been folded in ready condition to be placed at the foot of the bed.
Figure 2:
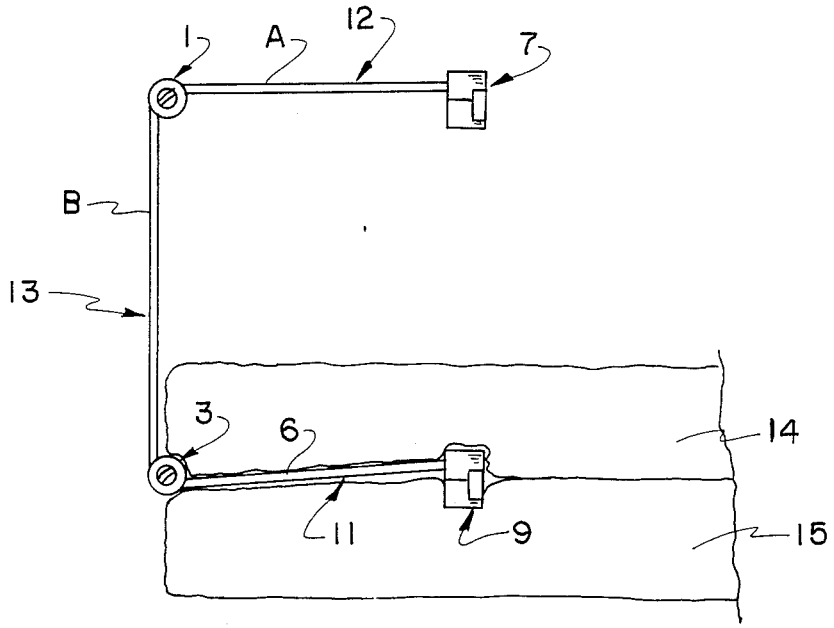
FIG. 2 is a side elevational view illustrating the device mounted on a bed.

In FIG. 1 I have, for ease of description, labeled the various pivot means 1 through 10 and have labeled the various corresponding post means (which interconnect the pivot means) by corresponding letter and letter/-number combinations A, A-1; B, B-1; etc. The same numbers and letters have been applied to FIGS. 2–4. Referring to FIGS. 1 and 2, the device includes a base portion 11, support portion 12, and a connector portion 13 between the two.

The base portion 11 is adapted to fit between the mattress 14 and spring 15 as particularly noted in FIG. 2. The connector portion 13 extends up by the edge of the mattress and the support portion 12 extends out from the connector portion 13 above the surface of the mattress 14 and serves to elevate the bed clothing in the foot/toe area.

The pivots 1 and 2 are spaced apart and each pivot comprises (as explained more in detail later) two moveable parts which are connected to relatively move in a plane between 0° and 90°. The pivots 1 and 2 are oriented so that the axes of rotation are coaxial with a first common rotational axis 16. The relative rotational motion of the pivotal parts is between the horizontal and the vertical as noted by the arrow 20.

The pivots 3 and 4 are spaced apart respectively in vertical alignment with the pivots 1 and 2. Pivots 3 and 4 are identical to pivots 1 and 2, each comprising two moveable parts which are connected to relatively move in a plane between 0° and 90°. The pivots 3 and 4 are oriented so that the axes of rotation are coaxial with a second common axis 21 which is parallel to the axis 16. The relative rotational motion of the pivot parts is between the horizontal and the vertical as noted by the arrow 22.

A first vertically extending post B is connected respectively to one part of pivots 1 and 3. A second vertically extending post B-1 is connected respectively to one part of pivots 2 and 4. These posts are secured in appropriate sockets in the pivot parts.

Pivot 5 comprises two moveable parts connected to relatively move in a plane between 0° and 180°. The axis of rotation is horizontal and lies in or is parallel to a plane containing the first common axis 16 and the projection of the axis intersects the first common axis 16 midway between the pivots 1 and 2. The relative rotational motion of the pivot parts takes place over the 180° as indicated by the arrow 23. In the position shown, the two parts of pivot 5 are butted together so the a downward force on the pivot will not cause the same to rotate.

The pivot 7 is identical to pivots 1–4 and comprises two moveable parts connected to relatively move in a plane between 0° and 90°. The pivot 7 is oriented so that its axis of rotation is vertical. The relative rotational motion of the two parts of the pivot can take place as indicated by the arrow 24.

A first horizontally extending post A is connected between the other part of the pivot 1 and one part of the pivot 7. A second horizontally extending post D is connected between the other part of the pivot 7 and one part of the pivot 5.

Referring to pivot 1, in the position shown the moveable parts are butting one another so that no downward motion of the post A can take place.

It will be apparent that the pivot 7 and the posts A and D form a first horizontally oriented L-shaped support for the bed clothes.

Pivot 8 is identical to the pivots 1–4 and 7 and comprises two moveable parts connected to relatively move in a plane between 0° and 90°. The pivot is oriented so that the axis of rotation is vertical. relative rotational motion of the two pivots is indicated by the arrows 25.

A third horizontally extending post A-1 is connected between the other part of the pivot 2 and one part of the pivot 8. A second horizontally extending post E is connected between the other part of the pivot 8 and the other part of pivot 5.

Referring to the pivot 2, in the position shown the moveable parts are abutting one another so that no downward motion of the post A-1 can take place.

It will be seen that the pivot 8 and the post A-1 and E form a first horizontally oriented L-shaped support for the bed clothes.

From the foregoing explanation, it will be evident that the support portion 12 includes the pivots 1, 7, 5, 8, and 2 and the posts A, D, E, and A-1. Bed clothing in contact with the foregoing will be elevated above the level of the bed.

Pivot 6 is the same as pivot 5 and comprises two moveable parts connected to relatively move in a plane between 0° and 180°. The axis of rotation is horizontal and lies in or is parallel to a plane containing the second common axis 21 and the projection of the axis intersects the second common axis midway between pivots 3 and 4. The relative rotational motion of the pivot posts takes place on 180° as indicated by the arrows 26.

The pivot 9 is identical to pivots 1, 4, 7, & 8 and comprises two moveable parts connected to relatively move in a plane between 0° and 90°. The pivot 9 is oriented so that its axis of rotation is vertical. The relative rotational motion of the parts of the pivot can take place as indicated by the arrow 30.

A fifth horizontally extending post C is connected between the other part of pivot 3 and one part of pivot 9. A sixth horizontally extending post D-1 is connected between the other part of pivot 9 and one part of pivot 6.

It will be apparent that the pivot 9 and the posts C and D-1 form a third horizontally oriented L-shaped base section.

Pivot 10 is identical to pivots 1–4 and 7–9 and comprises to moveable parts connected to relatively move in a plane between 0° and 90°. The pivot is oriented so that the axis of rotation is vertical. The relative rotational motion of the two parts indicated by the arrow 31.

A seventh horizontally extending post C-1 is connected between the other part of the pivot 4 and one part of the pivot 10. An eighth horizontally extending post E-1 is connected between the other part of pivot 10 and the other part of pivot 6.

It will be seen that the pivot 10 and posts C-1 and E-1 form a fourth L-shaped base section.

Figure 5:
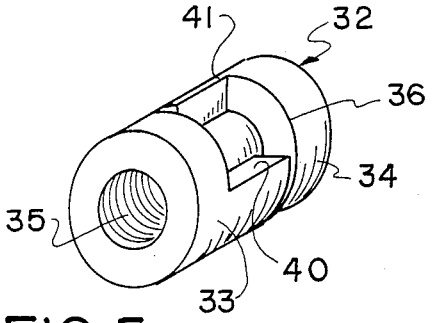
FIG. 5 is a perspective view of one type of pivot used in the construction of the device of FIG. 1.

The pivots 1–4 and 7–10 have the same structure as pivot 32 in FIG. 5. The pivot 32 is of conventional structure comprising two parts 33 and 34 which are rotatably mounted on a shaft 35 and abut one another at 36 in sliding relationship. The parts are urged together by spring means not shown.

The part 33 has a 180° socket 40 and the part 34 has a 45° extension 4 which slides in the socket. This provides for relative rotation over 90°.

Figure 6:
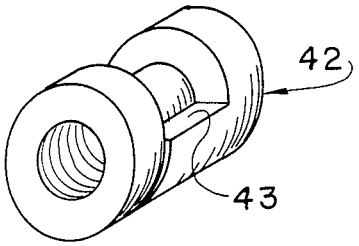
FIG. 6 is a perspective view of another type of pivot used in the construction of the device of FIG. 1.

The pivots 5 and 6 have the same structure as the pivot 42 in FIG. 6. Pivot 42 is the same as pivot 32 except that the socket 43 is 225° which permits the 180° travel.

I will now comment on the folding feature of the invention.

Figure 3:
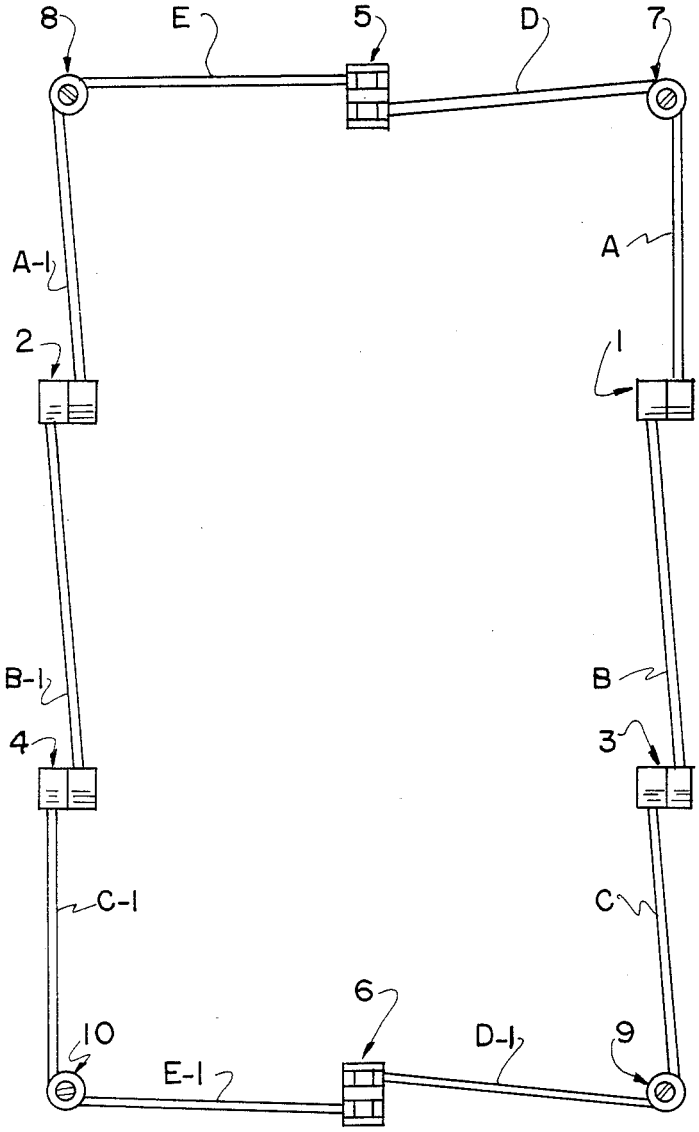
FIG. 3 is a plan view of the device of FIG. 1 (reduced) folded into a flat condition.

In FIG. 3 I have shown one type of folded position. This is preferably accomplished by positioning the connector portion 13 on a flat surface and then rotating the base portion 11 and support portion 12 down on the flat surface and the device assumes the position noted in FIG. 3.

If further reduction is cross-sectional area is desired, this can be achieved by folding over the right-hand part of the device as shown in FIG. 3 until it is in engagement with the left-hand part as noted in FIG. 5. This latter motion, of course, is accomodated by the pivots 5 and 6.

Figure 4:
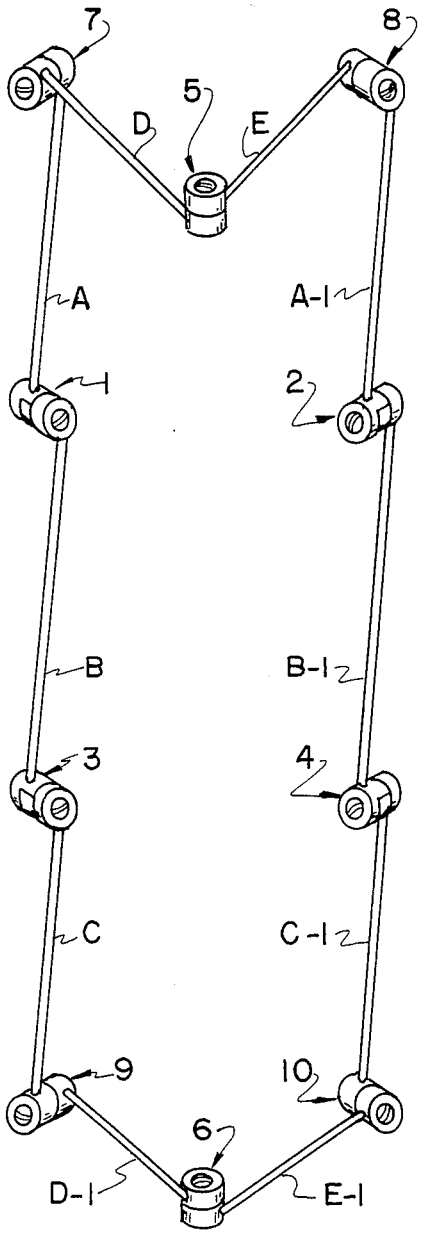
FIG. 4 is a plan view of the folded device of FIG. 3 which has been folded to reduce the plan cross-sectional area.

As will be apparent, the configurations of FIGS. 3 and 4 are highly desirable from both the storage and transportation aspects. With reference to FIG. 4, the device has a slight angled condition. For shipping purposes, the devices are stacked in reverse position in the shipping carton.

I claim:

1. For a bed having a mattress supported on a spring, a unitary device for elevating a portion of bed clothing above the level of the mattress comprising:

a base portion for insertion between the mattress and the spring;

a support portion to extend over the mattress and support the bed covering;

a connector portion between the base portion and the support portion; and said portions being comprised of interconnected pivot means and post means which provide for the base portion, the connector portion, and the support portion to be oriented with respect to one another for the base portion to be inserted between the mattress and the spring and for the support portion to extend over the mattress and also providing for the base portion, the connector portion, and the support portion to be oriented with respect to one another to assume a substantially planar condition for storage.

2. For a bed having a mattress supported on a spring, a unitary device which can be folded to a condition for elevating a portion of the bed covering at the foot end of the bed above the level of the matrress and which can be unfolded to a substantially planar condition for storage, the device comprising:

first and second spaced apart pivot means, each pivot means comprising two moveable parts connected to relatively move in a plane between 0° and 90° and the pivots being spaced apart and oriented to rotate about a first horizontal common axis;

third and fourth, spaced-apart pivot means respectively vertically aligned with said first and second pivot means, each pivot means comprising two moveable parts connected to relatively move in a plane between 0° and 90° and oriented to rotate about a second common axis which is parallel to said first common axis;

first vertically extending post means connected to one part of said first pivot means and toone part of said second pivot means;

second vertically extending post means connected to one part of said third pivot means and to one part of said fourth pivot means;

a fifth pivot means comprising two moveable parts connected to relatively move in a plane between 0° and 180°, the fifth pivot means being spaced from the first and second pivot means and oriented so that its axis of rotation lies in a horizontal plane containing said first common axis and the projection of the axis intersects said first common axis substantially at mid-way between the first and second pivot means;

first horizontally oriented L-shaped support means extending between said first and fifth pivot means, one end of the support means being connected to the other part of said first pivot means and the opposite end of the support means being connected to one part of said fifth pivot means, the support means being for use in being engaged with bed clothing and elevating the same above the level of the mattress;

second horizontally oriented L-shaped support means extending between said second and fifth pivot means, one end of the support means being connected to the other part of said second pivot means and the opposite end of the support means being connected to the other part of said fifth pivot means, the support means being for use in being engaged with bed clothing and elevating the same above the level of the mattress;

sixth pivot means comprising two moveable parts connected to relatively move in a plane between 0° and 180°, the sixth pivot means being spaced from the third and the fourth pivot means and oriented so that its axis of rotation lies in a horizontal plane containing said second common axis and the projection of the axis intersecting the second common axis substantially at midway between the second and third pivot means;

first horizontally oriented L-shaped base section means extending between said third and sixth pivot means, one end of the base section means being connected to the other part of said third pivot means and the opposite end of the base section means being connected to one part of said sixth pivot means;

second horizontally extending L-shaped base section means extending between said fourth and sixth pivot means, one end of the base section being connected to the other part of said fourth pivot means and the opposite end of the base section being connected to the other of said sixth pivot means; and said base section means being for use in being retained between a mattress and a spring and said first and second vertically extending post means being for use in positioning said support means to perform their said elevating function.

3. The device of claim 2:

wherein said first support means includes:

(a) a seventh pivot means comprising two moveable parts connected to relatively move in a plane between 0° and 90°, the axis of rotation being vertical;

(b) first horizontally extending post means connected between said other part of said first pivot means and to one part of said seventh pivot means; and (c) second horizontally extending post means connected between the other post of said seventh pivot means and said one part of said fifth pivot means;

wherein said second support means includes:

(d) eighth pivot means comprising two moveable parts connected to relationally move in a plane between 0° and 90°, the axis of rotation being vertical;

(e) third horizontally extending post means connected between said other part of said second pivot means and to one part of said eighth pivot means; and (f) fourth horizontally extending post means connected between the other post of said eighth pivot means and said other part of said fifth pivot means;

wherein said first base section means includes:

(g) ninth pivot means comprising two moveable post connected to relatively move in a plane between 0° and 90°, the axis of rotation being vertical;

(h) fifth horizontally extending post means connected between said other part of said third pivot means and to one part of said ninth pivot means; and (i) sixth horizontally extending post means connected between said other part of said ninth pivot means and said one part of said sixth pivot means;

wherein said second base section means includes:

(j) tenth pivot means comprising two moveable pivots connected to relatively move in a plane between 0° and 90°, the axis of rotation being vertical;

(k) seventh horizontally extending post means connected between said other part of said fourth pivot means and to one part of said tenth pivot means;

(l) eighth horizontally extending post means connected between the other part of said tenth pivot means and said other pivot of said sixth pivot means.

* * * * *